US005175769A

United States Patent [19]

Hejna, Jr. et al.

[11] Patent Number: 5,175,769

[45] Date of Patent: Dec. 29, 1992

[54] METHOD FOR TIME-SCALE MODIFICATION OF SIGNALS

[75] Inventors: Donald J. Hejna, Jr., Sunnyvale, Calif.; Bruce R. Musicus, Arlington, Mass.; Andrew S. Crowe, San Jose, Calif.

[73] Assignee: ROLM Systems, Santa Clara, Calif.

[21] Appl. No.: 734,424

[22] Filed: Jul. 23, 1991

[51] Int. Cl.[5] ..... G10L 5/00

[52] U.S. Cl. ..... 381/34; 381/35

[58] Field of Search ..... 381/34, 35; 360/8

[56] References Cited

U.S. PATENT DOCUMENTS

| | | | |
|---|---|---|---|
| 3,104,284 | 9/1963 | French et al. | 179/15.55 |
| 3,462,555 | 8/1969 | Presti | 179/15.55 |
| 3,786,195 | 1/1974 | Schiffman | 179/15.55 |
| 3,949,175 | 4/1976 | Tanizoe et al. | 179/15.55 |
| 4,020,291 | 4/1977 | Kitamura et al. | 179/15.55 |
| 4,246,617 | 1/1981 | Portnoff | 360/32 |
| 4,356,353 | 10/1982 | Eng et al. | 179/15.55 |
| 4,852,168 | 7/1989 | Sprague | 381/35 |
| 4,864,620 | 9/1989 | Bialick | 381/34 |
| 4,885,790 | 12/1989 | McAulay et al. | 381/36 |
| 4,890,325 | 12/1989 | Taniguchi et al. | 381/34 |
| 4,937,873 | 6/1990 | McAulay et al. | 381/51 |

FOREIGN PATENT DOCUMENTS 0392049 10/1990 Fed. Rep. of Germany .

OTHER PUBLICATIONS

"Speech Transformations Based on a Sinusoidal Representation" T. F. Quatrieri 1986.

"Some Improvements on the Synchronized-Overlap-Add Method of Time Scale Modification for Use in Real-Time Speech Compression and Noise Filtering" by J. L. Wayman, 1988.

"Digital Processing of Speech Signals", L. R. Rabiner & R. W. Schafer, 1978.

"Time-Domain Algorithms for Harmonic Bandwidth Reduction and Time Scaling of Speech Signals", D. Malah, 1979.

"Performance of Transform and Subband Coding Systems Combined with Harmonic Scaling of Speech", D. Malah, 1981.

"Signal Estimation from Modified Short-Time Fourier Transform", D. W. Griffin 1984.

"High Quality Time-Scale Modification for Speech", S. Roucos, 1985.

"Time-Scale Modification in Medium to Low Rate Speech Coding", J. Makhoul 1986.

*Primary Examiner*—Emanuel S. Kemeny

*Attorney, Agent, or Firm*—Michael B. Einschlag

[57] ABSTRACT

Method for time-scale modification ("TSM") of a signal, for example, a voice signal, wherein starting positions of blocks in an input signal, referred to as analysis windows, are varied and an output signal is reconstructed by overlapping analysis windows using fixed window offsets, i.e., the duration of overlap between analysis windows is fixed during reconstruction. This is done by searching for segments of the input signal which are similar to the previous portion of the output signal. In one embodiment of the present invention a cross-correlation is used as a similarity measure to evaluate such similarity and the cross-correlation uses a fixed, predetermined minimum number of samples. The starting position of the analysis window which results in the greatest similarity in overlapping regions is determined as the starting position which provides the largest value of cross-correlation in the overlapping regions. Several cross-correlations are evaluated by shifting the analysis window over a predetermined number of samples, removing the first shifted samples in the evaluation each time, and using the same, predetermined number of samples in the evaluation to determine the "best" starting position for an analysis window. Finally, the predetermined number of samples from the beginning of the analysis window are averaged with the predetermined number of samples from the end of the previous portion of the output signal and the remaining samples in the window are appended to the averaged segment of the previous portion of the output signal.

20 Claims, 6 Drawing Sheets

METHOD FOR TIME-SCALE MODIFICATION OF SIGNALS

TECHNICAL FIELD OF THE INVENTION

The present invention relates to a method for time-scale modification ("TSM"), i.e., changing the rate of reproduction, of a signal and, in particular, to a method for time-scale modification of a sampled signal by time-domain processing of the sampled signal to provide reproduction of the signal at a wide variety of playback rates without an accompanying change in local periodicity.

BACKGROUND OF THE INVENTION

A need exists in the art for a method for time-scale modification of acoustic signals such as speech or music and, in particular, a need exists for such a method which will provide time-scale modification without modifying the pitch or local period of the time-scale modified signals. Thus, a need exists for a method for changing the perceived rate of articulation while ensuring that the local pitch period of the resulting signal remains unchanged, i.e., there are no "Alvin the Chipmunk" effects, and that no audible splicing, reverberation, or other artifacts are introduced.

Specifically, time-scale modification ("TSM") of a signal by time-scale compression, i.e., a method for speeding-up a playback rate of the signal, or by time-scale expansion, i.e., a method for slowing-down the playback rate of the signal, is needed to match the time-scale of the signal with a predetermined duration. For example, TSM can be used: (a) by a radio station to speed up dance music; (b) by a blind person to speed up a recorded lecture; (c) by a student of a foreign language to slow down instructional material; (d) by an editor to synchronize a dubbed sound track with a video signal and to compress them into convenient time slots; (e) by a secretary to slow down or speed up a dictation tape for transcription; (f) by a voicemail system to provide a message to a listener at a faster or slower rate than that at which the message was recorded; and so forth.

When a segment of an input signal is compressed to speed-up the signal, the informational content of the compressed signal is reduced relative to that contained in the input signal to produce an output segment of shorter duration. Ideally, compression should delete an integer multiple of local pitch periods and these deletions should be distributed evenly throughout the input segment. Further, to preserve intelligibility, no phoneme should be removed completely.

When a segment of an input signal is expanded to slow-down the signal, the information content of the expanded signal is increased relative to that contained in the input signal to produce an output segment of longer duration. Ideally, expansion should insert additional pitch periods which are distributed evenly throughout the input segment. This proves to be difficult in practice, however, since the local pitch period varies across phonemes and may be difficult to gauge during nonperiodic portions of a speech signal such as fricatives.

Several methods have been developed in the prior art to provide TSM. Previously, TSM was accomplished using three basic methods: frequency domain processing methods, analysis/synthesis methods, and time-domain processing methods. However, all of these prior art methods have drawbacks. For example, an article entitled "Signal Estimation from Modified Short-Time Fourier Transform" by D. W. Griffin and J. S. Lim in *IEEE Transactions on ASSP*, Vol. ASSP-32, No. 2, April, 1984, pp. 236–243, introduced a frequency-domain processing method which iteratively synthesizes an output signal having a spectrogram which is a compressed or expanded version of a spectrogram of an input signal. Although the disclosed method works well on almost any acoustic material, it has a drawback in that it requires a large amount of computation. As a result, even though this prior art frequency domain processing method is robust, it is so computationally intensive that it cannot be utilized in many real-time applications.

Analysis/synthesis methods operate by reducing an input speech signal into a set of time varying parameters which can be time-scaled, this being referred to as analysis, and by utilizing the time varying parameters to construct a time-scale modified signal, this being referred to as synthesis. For example, a method suggested by T. F. Quatrieri and R. J. McAulay in an article entitled "Speech Transformations Based on a Sinusoidal Representation," *IEEE Transactions on ASSP*, Vol. ASSP-34, December, 1986, pp. 1449–1464 utilizes a limited number of sinusoids to model a speech signal. Then, in accordance with the disclosed method, the time-scale of the input signal is modified by varying the rate at which the sequence of sinusoids is played back. Although such analysis/synthesis methods require less computation than frequency domain processing methods, they have a drawback in that they are restricted to signals which can be represented by a limited number of time-varying parameters. As a result, analysis/synthesis methods generally perform poorly on more complex signals, such as speech signals which are corrupted by noise or which contain music.

Time-domain methods operate by inserting or deleting segments of a speech signal. One of the original time-domain methods of TSM was proposed in the 1940s and entailed splicing, i.e., abutting, different regions of a signal at a fixed rate to compress or expand tape recordings. This method results in discontinuities in transitions between inserted or deleted segments and such discontinuities lead to bothersome clicks and pops in the resulting time-scale modified signal.

Several attempts have been made in the art to minimize the effects of inter-segment transitions in a time-scale modified signal by improving the splicing method or by windowing adjacent segments. In general, these methods improve quality at the expense of increasing complexity. One such method of time-domain TSM, i.e., "Time-Domain Harmonic Scaling" ("TDHS"), is disclosed in an article entitled "Time-Domain Algorithms for Harmonic Bandwidth Reduction and Time Scaling of Speech Signals" by D. Malah, *IEEE Transactions on ASSP*, Vol. ASSP-27, April, 1979, pp. 121–133. This article discloses a TDHS algorithm which improves on the original method of splicing by synchronizing splice points to a local pitch period and by using overlap-add techniques to fade smoothly between the splices. In particular, the TDHS algorithm operates by determining the location of each pitch period in the input signal to be modified and then by segmenting the signal around these pitch periods to achieve the desired modification. In accordance with this TDHS method, an integer number of pitch periods has to be inserted or deleted and it is necessary to maintain a record of the modifications to insure that an appropriate number thereof took place. The TDHS method provides good quality in the class of low complexity time-domain methods.

An alternative to the TDHS method is disclosed in an article entitled "High Quality Time-Scale Modification for Speech" by S. Roucos and A. M. Wilgus, *Proceedings ICASSP* 86, *Tokyo,* March, 1985, pp. 493–496. This article discloses a Synchronized Overlap-Add ("SOLA") time-domain processing method which has low complexity and which operates without regard to pitch periods in a speech signal. In accordance with the SOLA method, an input signal is sampled and the samples are segmented at a fixed analysis rate into frames, referred to as windows, and the windows are shifted in time to maintain a predetermined average time-compression or expansion. The windows are then overlap-added at a dynamic synthesis rate to provide an output. In accordance with this method, the input signal is windowed using a fixed, inter-frame shift interval and the output signal is reconstructed using dynamic, inter-frame shift intervals. The inter-frame shift interval used during reconstruction is allowed to vary so that a shift which maximizes the cross-correlation of a current window with previous windows is used. Hence, this method results in a region of overlap which is dynamic between windows and which requires evaluation of a cross-correlation with a variable number of points. As a result, this method allows one to change the relative overlap between windows which, in turn, modifies the time-scale of the input signal without significantly affecting the periods in the signal.

The SOLA method may be understood in light of the following description which should be read in conjunction with FIG. 1. First, with reference to FIG. 1, there are four parameters which are used in the SOLA method: (a) window length W is the duration of windowed segments of the input signal—this parameter is the same for the input and output buffers and represents the smallest unit of the input signal, for example, speech, that is manipulated by the method; (b) analysis shift $S_a$ is the interframe interval between successive windows along the input signal; (c) synthesis shift $S_s$ is the interframe interval between successive windows along the unshifted output signal; and (d) shift search interval $K_{max}$ is the duration of the interval over which a window may be shifted for purposes of aligning it with previous windows.

The SOLA method modifies the time-scale of an input signal in two steps which are referred to as analysis and synthesis, respectively. The analysis step comprises cutting up the input signal, x[n]—n is a sample index and x[n] is the value of the $n^{th}$ sample—into possibly overlapping windows—$x_m[n]$ is the $n^{th}$ sample of the $m^{th}$ input window. Each input window has a fixed length W and is separated by a fixed analysis distance $S_a$. In accordance with the SOLA method:

$$x_m[n] = \begin{cases} x[mS_a + n] & \text{for } n = =0, \ldots, W-1 \\ 0 & \text{otherwise} \end{cases} \quad (1)$$

The synthesis step comprises overlap-adding the windows from the analysis step every $S_s$ samples. Each new window is aligned with the sum of previous windows before being added to reduce discontinuities in the resulting signal which arise from the different interframe intervals which are used during analysis and synthesis, i.e., the windows are overlapped and recombined with the separation between them compressed or expanded so that, on average, windows are separated by a new synthesis distance $S_s$. The ratio $a=S_s/S_a$ gives the desired compression or expansion rate where $a>1$ corresponds to expansion and $a<1$ corresponds to compression. The approximate duration of the modified signal is given by "a * (duration of the input signal)."

The synthesis shift which is actually used for the $m^{th}$ window $x_m[n]$, i.e., $x_m[n]=x[mS_a+n]$ for $n=0, \ldots, W-1$, is adjusted by an amount $k_m$ which is less than or equal to $K_{max}$ in order to maximize a similarity measure of data in the overlapping regions before the overlap-add step is carried out. As a result, in accordance with the SOLA method, the output y[i], where i is a sample index and y[i] is the value of the $i^{th}$ sample, is formed recursively by:

$$y[mS_s+k_m+n] \leftarrow b_m[n]y[mS_s+k_m+n]+(1-b_m[n])x_m[n] \text{ for } n=0, \ldots, W^m{}_{OV}-1 \quad (2)$$

and $$y[mS_s+k_m+n] \leftarrow x_m[n] \text{ for } n=W^m{}_{OV}, \ldots, W-1 \quad (3)$$

where: $W^m{}_{OV}$ is the number of overlap points for the $m^{th}$ window and $W^m{}_{OV}=k_{m-1}-k_m+W-S_s$. Further, shift $k_m$ is selected to maximize a similarity measure, for example, the cross-correlation or average magnitude difference, in the overlap region between the current output y and the $m^{th}$ window $x_m$. Still further, $b_m[n]$ is a fading factor between 0 and 1, for example, an averaging or a linear fade, which is chosen to minimize audible splicing artifacts.

The SOLA method has a drawback in that the amount of overlap for the $m^{th}$ window, $W^m{}_{OV}$, between the output and the $m^{th}$ analysis window varies with $k_m$ and this complicates the work required to compute the similarity measure and to fade across the overlap region. Also, depending on the shifts $k_m$, more than two windows may overlap in certain regions and this further complicates the fading computation.

As a result, there is a need in the art for a method for modifying the time-scale of speech, music, or other acoustic material without modifying the pitch, which is robust, and which does not require excessive amounts of computation.

SUMMARY OF THE INVENTION

Embodiments of the present invention advantageously satisfy the above-identified need in the art and provide a method for modifying the time-scale of speech, music, or other acoustic material over a wide range of compression and expansion without modifying the pitch.

The inventive method is an improvement on the SOLA method described in the Background of the Invention and is referred to here as a Synchronized Overlap-Add, Fixed Synthesis time domain processing method ("SOLAFS"). In general, the inventive method comprises superimposing partially overlapping blocks of signal samples from an input signal in a manner which aligns similar signal blocks from different locations in the input signal. Further, in accordance with a preferred embodiment of the present invention, if the distance between similar blocks of the input signal to be superimposed is greater than the distance between superimposition regions, the rate of reproduction will be increased, i.e., time-scale will be compressed. Correspondingly, if the distance between similar blocks of the input signal to be superimposed is less than the distance between superimpositions, the rate of reproduction will be decreased, i.e., time-scale will be expanded.

In accordance with the present invention, blocks of the input signal, referred to as analysis windows, are taken at an average rate of $S_a$ with each starting position allowed to vary within limits and an output signal is reconstructed using a fixed inter-block offset $S_s$, i.e., the duration of overlap with the existing signal in each window to be added is fixed. This is done by searching for segments of the input signal near the target starting position $mS_a$ which are similar to the portion of the output signal that will overlap when constructing the output signal. A similarity measure is used to evaluate such similarity and, in accordance with the present invention, the similarity measure uses a fixed, predetermined minimum number of samples. The fact that the region of overlap is fixed is advantageous because the number of computations which are required to evaluate the similarity measure over the range of shift values are reduced over that required in the prior art SOLA method. Several similarity measures are evaluated by shifting the starting point of an analysis window over a predetermined number of samples, i.e., removing samples from the beginning of the analysis window as new samples from the input are appended to the tail of the analysis window, thus using the same, predetermined number of samples in the evaluation. The starting position of the analysis window which provides the maximum similarity in the region of the analysis window which will overlap with the region of the output signal is selected from all starting positions tested. Finally, the predetermined number of samples in the region of overlap are combined with the predetermined number of samples from the end of the previous portion of the output signal and the remaining samples in the window are appended to the combined segment of the previous portion of the output signal.

An important attribute of the SOLAFS method is that the starting position which provides the maximum similarity over the range of possible starting positions for a given input block can often be determined without evaluating the similarity measure for all possible starting positions. This method of determining the "best" shift without evaluating all possible shifts is referred to as "prediction." "Prediction" occurs when the fixed region of the output signal which is used in the similarity measure evaluation is also contained in the range of possible starting positions for the next input block. Whenever this occurs, one can "predict" with certainty that a shift which overlaps these identical regions will maximize the similarity measure. Although "prediction" is not possible for all cases, for moderate changes in the time-scale or for processing in which small inter-block intervals are used, "prediction" is possible quite often. As one can readily appreciate, "prediction" is highly advantageous because it obviates the need to merge the overlapping regions since they are identical. As a result, only data points beyond the region of overlap from the new input block need to be appended to the output to extend the signal.

Since the inventive method uses fixed segment lengths which are independent of local pitch, the inventive SOLAFS method advantageously operates equally well on speech or non-speech signals. Further, since the inventive method aligns only a fraction of an analysis window to the time-scaled signal, the inventive SOLAFS method advantageously is more efficient than the SOLA method and provides greater flexibility in choice of parameters. Still further, since the inventive method maintains the extent of superimposition constant throughout each frame and fixes it over the range of reproduction rates, the inventive SOLAFS method advantageously simplifies the computation required when compared to the computation required to carry out the SOLA method. As a result, the inventive SOLAFS method advantageously provides a robust time-scale modification ("TSM") signal using substantially less computation than SOLA or TDHS and the TSM signal is unaffected by the presence of white noise in the input signal. Further, using a relatively small amount of trial and error, one can determine parameters for use in embodying the inventive method so that the resultant time-scale modified speech contains few audible artifacts and preserves speaker identity.

BRIEF DESCRIPTION OF THE DRAWING

A complete understanding of the present invention may be gained by considering the following detailed description in conjunction with the accompanying drawing, in which.

DETAILED DESCRIPTION

The present invention relates to a method for time-scale modification ("TSM"), i.e., changing the rate of reproduction, of a signal and, in particular, to a method for time-scale modification of a sampled signal by time-domain processing the sampled signal to provide reproduction of the signal at a wide variety of rates without an accompanying change in pitch. An input to the inventive method is a stream of digital samples which represent samples of a signal. There exist many apparatus which are well known to those of ordinary skill in the art for receiving an input signal such as a voice signal and for providing digital samples thereof. For example, it is well known to those of ordinary skill in the art that commercially available equipment exists for receiving an input analog signal and for sampling the signal at a rate which is at least the Nyquist rate to provide a stream of digital signals which may be converted back into an analog signal without loss of fidelity. The inventive method accepts, as input, the stream of digital samples and produces, as output, a stream of digital samples which are representative of a TSM signal. The TSM digital output is then converted back into an analog signal using methods and apparatus which are well known to those of ordinary skill in the art.

Figure 1:
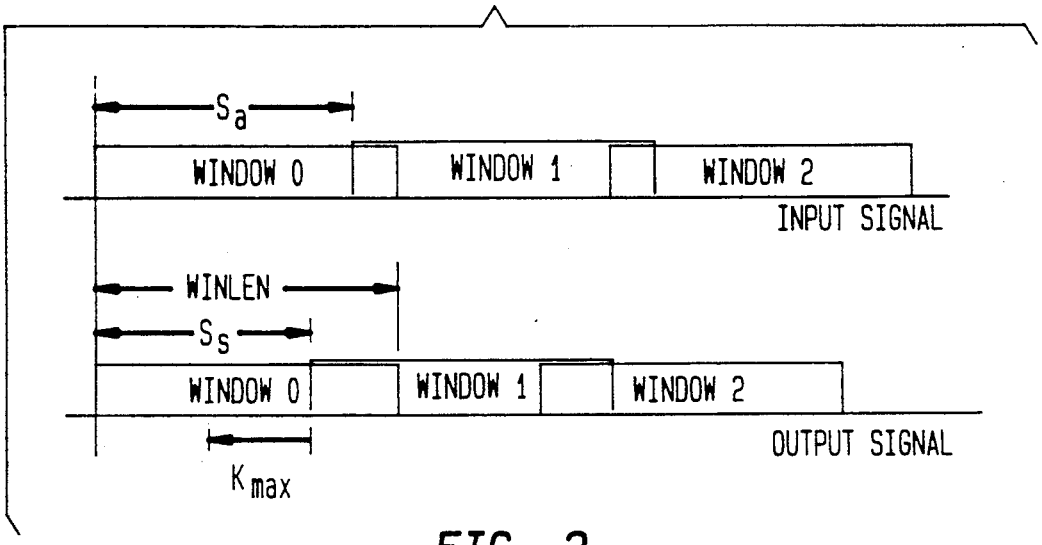
FIG. 1 (PRIOR ART)
FIG. 1 shows, in pictorial form, the manner in which the prior art SOLA method operates to provide time-scale compression for an input signal.
Figure 2:
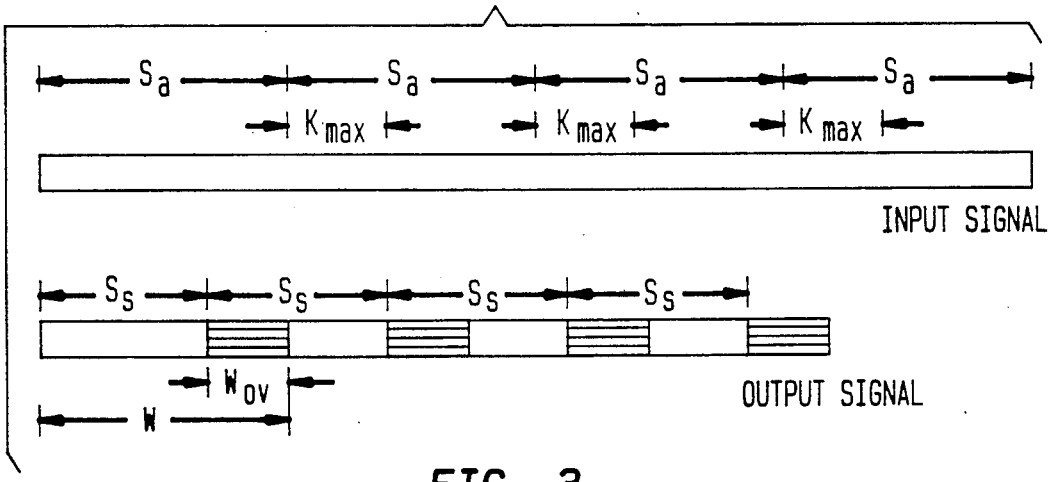
FIG. 2 shows, in pictorial form, the manner in which an embodiment of the inventive method operates to provide time-scale compression for an input signal.

The inventive method is an improvement of the prior SOLA method discussed in the Background of the Invention, which inventive method is referred to as the Synchronized Overlap-Add, Fixed Synthesis method ("SOLAFS"). With reference to FIGS. 1 and 2, there are four parameters which are used in the inventive SOLAFS method: (a) window length W is the duration of windowed segments of the input signal—this parameter is the same for input and output buffers and represents the smallest unit of the input signal, for example, speech, that is manipulated by the method; (b) analysis shift $S_a$ is the interframe interval between successive search ranges for analysis windows along the input signal; (c) synthesis shift $S_s$ is the interframe interval between successive analysis windows along the output signal; and (d) shift search interval $K_{max}$ is the duration of the interval over which an analysis window may be shifted for purposes of aligning it with the region of the output signal it will overlap.

In essence, the first $W_{OV}$ samples in each new window in the input signal, referred to as an analysis window, are overlap-added with the last $W_{OV}$ samples in the output signal, i.e., this is referred to as overlap-adding at a fixed synthesis rate. In accordance with the inventive method, the starting point of each analysis window is varied by: (a) evaluating a similarity measure such as, for example, the cross-correlation, of the first $W_{OV}$ points in the analysis window with the last $W_{OV}$ points in the output signal, where $W_{OV}$ is a predetermined, fixed number; (b) then the starting point of the analysis window is shifted by a fixed amount and a new cross-correlation of the first $W_{OV}$ points in the new analysis window with the same last $W_{OV}$ points in the output signal is evaluated; (c) step (b) is performed a predetermined number of times, $K_{max}$, and the new analysis window is chosen to be the one wherein the cross-correlation is maximized. Finally, the first $W_{OV}$ samples in the new analysis window are overlap-added with the last $W_{OV}$ samples in the output signal and $S_s$ additional points from the analysis window are appended to the output signal The term overlap-added refers to a method of combination such as averaging points or performing a weighted average in accordance with a predetermined weighting function.

In the following x[i] represents the $i^{th}$ sample in the input digital stream representative of an input signal. In accordance with the inventive method, analysis windows are chosen as follows:

$$x_m[n] = \begin{cases} x_m[mS_a + k_m + n] & \text{for } n = 0, \ldots, W-1 \\ 0 & \text{otherwise} \end{cases} \tag{4}$$

where: m is a window index, i.e., it refers to the $m^{th}$ window; n is a sample index in an input buffer for the input signal, which buffer is W samples long; $k_m$ is the number of samples of shift for the $m^{th}$ window; and $x_m[n]$ represents the $n^{th}$ sample in the $m^{th}$ analysis window.

The analysis windows are then used to form the output signal y[i] recursively in accordance with the following:

$$y[mS_s+n] \leftarrow b[n]y[mS_s+n] + (1-b[n])x_m[n] \text{ for } n=0, \ldots, W_{OV}-1 \tag{5}$$

and $$y[mS_s+n] \leftarrow x_m[n] \text{ for } n=W_{OV}, \ldots, W-1 \tag{6}$$

where: $W_{OV}=W-S_s$ is the number of points in the overlap region and b[n] is an overlap-add weighting function which is referred to as a fading factor—an averaging function, a linear fade function, and so forth.

Note that, in accordance with the present invention, shift $k_m$ affects the starting position of an analysis window in the input digital stream. For a particular window, an optimal shift is determined by maximizing a similarity measure between the overlapping samples in $x_m$ and y. A similarity measure which works well in practice is the normalized cross-correlation between x and y in the overlap region:

$$k_m \leftarrow \max_{0 \leq k \leq K_{max}} R^m_{xy}[k] \tag{6}$$

where $K_{max}$ is the maximum allowable shift from the initial starting position of the analysis window, and $$R^m_{xy}[k] = r^m_{xy}[k]/(r^m_{xx}[k] * r^m_{yy})^{\frac{1}{2}} \tag{7}$$

where:

$$r^m_{xy}[k] = \operatorname*{SUM}_{n=0}^{W_{OV}-1} x[mS_a + k + n]y[mS_s + n] \tag{8}$$

$$r^m_{xx}[k] = \operatorname*{SUM}_{n=0}^{W_{OV}-1} x^2[mS_a + k + n] \tag{9}$$

$$r^m_{yy} = \operatorname*{SUM}_{n=0}^{W_{OV}-1} y^2[mS_s + n] \tag{10}$$

Other similarity measures such as the average magnitude difference could also be utilized:

$$R^m_{avmag}[k] = \operatorname*{SUM}_{n=0}^{W_{OV}-1} |y[mS_s + n] - x[mS_a + k + n]| \tag{11}$$

However, this particular measure is not optimal since it is sensitive to signal amplitude.

Figure 3:
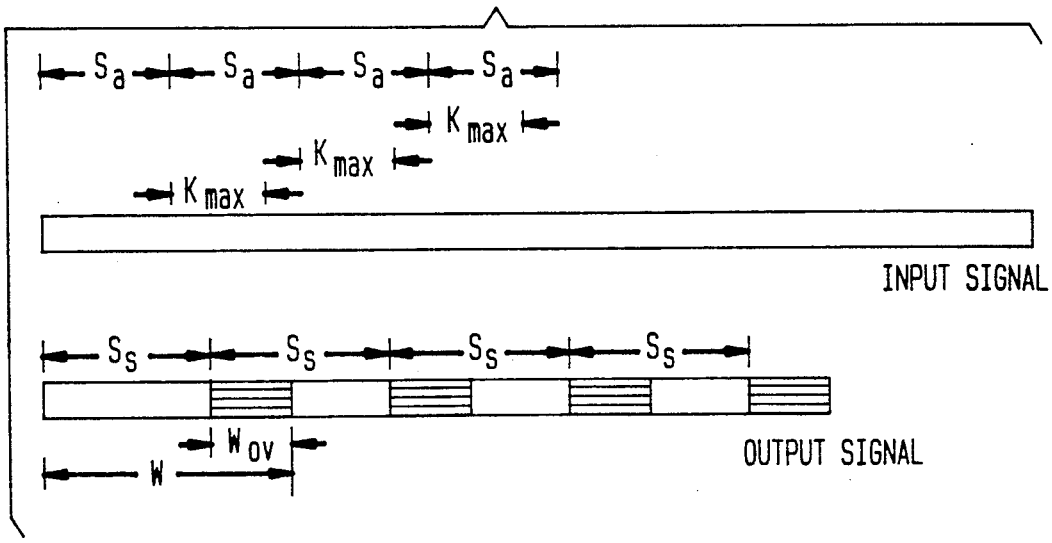
FIG. 3 shows, in pictorial form, the manner in which an embodiment of the inventive method operates to provide time-scale expansion for an input signal.

Finally, note that overlap regions occur in the output with a predictable rate, $S_s$, and have a fixed length, $W_{OV}$. This can be seen in FIG. 2 which shows a TSM compressed signal and FIG. 3 which shows a TSM expanded signal. Therefore, a fixed-length fading function b[n] can be used, and its values can be precomputed and stored in a lookup table.

Figure 4:
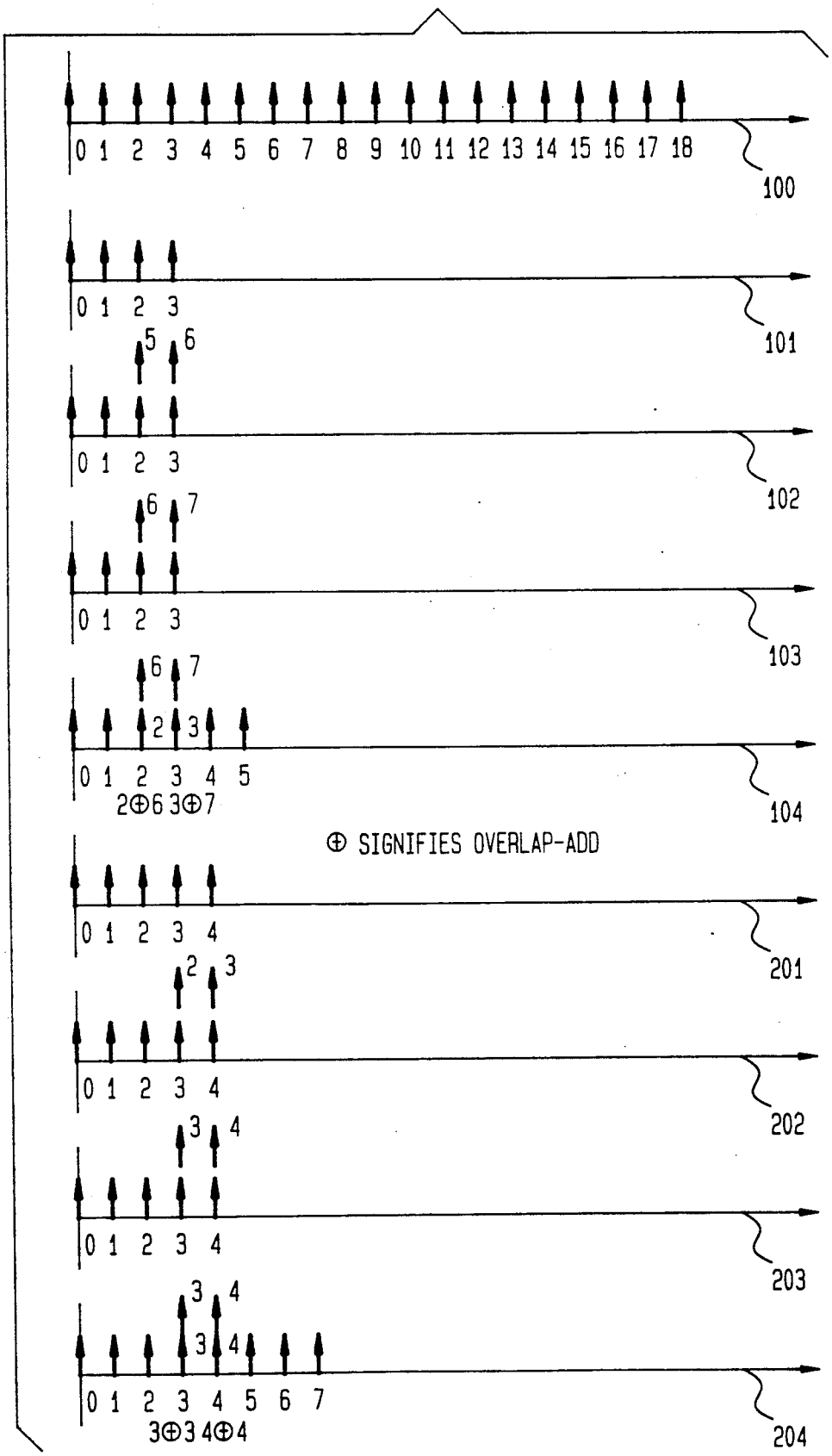
FIG. 4 shows a detailed analysis of the manner in which an embodiment of the inventive SOLAFS method operates.

The following provides an explanation of how the inventive SOLAFS method operates in detail in conjunction with FIG. 4. Referring to FIG. 4, the samples in the digital input stream 100 are labeled 1, 2, 3, and so forth. Although the relative heights of the arrows could be used to indicate the amplitude of a sample at a particular point in time, for purposes of the following description, the heights of the arrows have no particular significance.

First, we will consider a TSM compressed signal. In such a case $S_s < W < S_a$. For purposes of understanding the manner in which the inventive method operates, let $S_a=5$, $W=4$, $S_s=2$, and $W_{OV}=W-S_s=2$. As an initialization step, take W samples from the input signal, which samples are stored in an input signal buffer, and place them in an output sample buffer for the output signal. This is shown as line 101 in FIG. 4. Next, find the start of the first analysis window. The first analysis window starts at sample 5, $mS_a$ where $m=1$. Note that in accordance with the inventive method we are skipping over sample 4 at the end of the previous analysis window. Next, we will find the maximum similarity between the first $W_{OV}$ samples, i.e., 2 samples in this case, at the start of the analysis window and the end of the output signal. Referring to line 102 of FIG. 4, we compute the cross-correlation between samples 5 and 6 from the start of the analysis window and samples 2 and 3 from the end of the output window. Next, we shift the start of the analysis window by one and repeat the process. This is indicated as line 103 in FIG. 4 where we compute the cross-correlation between samples 6 and 7 from the new start of the analysis window and samples 2 and 3 from the end of the output window. This process is continued until we have shifted the analysis window by a maximum amount $K_{max}$ which is allowed. Then, we determine which shift corresponds to the maximum cross-correlation. Assume that the maximum cross-correlation occurs when we shift by one sample. In that case, we shift the starting position of the analysis window by one sample from the start of the search range in the input buffer, i.e., sample 6 rather than sample 5, overlap-add the last $W_{OV}$ samples of the output signal and the first $W_{OV}$ samples (6 and 7) from the start of the analysis window, and transfer $W-W_{OV}=2$ further samples into the output buffer. This is shown in line 104. Now, this process is repeated by choosing the next analysis window. The next analysis window starts at sample 10, i.e., $mS_a=10$ when $m=2$.

Second, we will consider a TSM expanded signal. In such a case $W>S_s>S_a$. For purposes of understanding the manner in which the inventive method operates, let $S_a=2$, $W=5$, $S_s=3$, and $W_{OV}=W-S_s=2$. As an initialization step, take W samples from the input signal and place them in the output buffer. This is shown as line 201 in FIG. 4. Next, find the start of the first analysis window. The first analysis window starts at sample 2, $mS_a=2$ when $m=1$. Next, we will find the maximum similarity between the first $W_{OV}$ samples, i.e., 2 samples in this case, at the start of the analysis window and the end of the output signal. Referring to line 202 of FIG. 4, we compute the cross-correlation between samples 2 and 3 from the start of the analysis window and samples 3 and 4 from the end of the output window. Next, we shift the start of the analysis window by one and repeat the process This is indicated as line 203 in FIG. 4 where we compute the cross-correlation between samples 3 and 4 from the new start of the analysis window and samples 3 and 4 from the end of the output window This process is continued until we have shifted the signal by the maximum amount $K_{max}$ which is allowed. Then, we determine which shift corresponds to the maximum cross-correlation. Assume that the maximum cross-correlation occurs when we shifted by one sample. In that case, we shift the starting point of the analysis window one sample from the start of the search range in the input buffer, i.e., start at sample 3 rather than sample 2, overlap-add the last $W_{OV}$ samples of the output signal and the first $W_{OV}$ samples from the start of the analysis window and transfer $W-W_{OV}=3$ further samples into the output buffer. This is shown in line 204. Now, this process is repeated by choosing the next analysis window. The next analysis window starts at sample 4, i.e., $mS_a=4$ when $m=2$.

It is interesting to note that despite a superficial similarity, SOLA and SOLAFS function quite differently. For example, the prior art SOLA method achieves compression by a factor of two by averaging two pitch periods into one. In the same situation, the inventive SOLAFS method splices out every other pitch period and uses short transition regions to smooth over the gap. More generally, if the distance $S_a$ is greater than the distance $S_s$, then, on average, $(S_a-S_s)$ samples are deleted between segments. Conversely, if $S_a$ is less than the distance $S_s$, then, on average, $(S_s-S_a)$ samples are replicated in adjacent segments. The actual shift used between windows is given by $(S_a+k_m)$, so that the duration of the deleted or repeated segment is $(S_a+k_m-S_s)$ and $(S_s-S_a-k_m)$ respectively and varies to provide smooth splices.

An advantage which occurs in accordance with the present invention occurs as a result of the fact that the shift distance $k_m$ which maximizes the similarity in the overlap region can often be predicted without computation of the similarity. This fact can be understood as follows. Assume that no more than two windows overlap at any point in the output. Then consider the state of the system just before the $m^{th}$ window.

Eqns. (5) and (6) indicate that the last $W_{OV}$ samples of the output y will be equal to samples in the input stream:

$$\begin{aligned} y[mS_s+n] &= y[(m-1)S_s+(S_s+n)] \\ &= x[(m-1)S_a+k_{m-1}+(S_s+n)] \\ &= x[mS_a+t_m+n] \end{aligned} \tag{12}$$

where: $t_m=k_{m-1}+S_s-S_a$.

Also assume that $0 \leqq t_m \leqq K_{max}$. Then, when the last $W_{OV}$ samples of the output $y[mS_s+n]$ are cross-correlated with the first $W_{OV}$ samples of possible analysis windows $x[mS_a+k+n]$, the maximum must be at $k_m=t_m$. With this offset, the output and input samples in the overlap region are identical and the normalized cross-correlation is 1. Thus, the $m^{th}$ shift, $k_m$, should be determined by:

$$k_m \leftarrow \begin{cases} t_m = k_{m-1}+(S_s-S_a) & \text{if } 0 \leqq t_m \leqq K_{max} \\ \max\limits_{0 \leqq k \leqq K_{max}} R^m_{xy}[k] & \text{otherwise} \end{cases} \tag{13}$$

Furthermore, if the $m^{th}$ shift is predictable, then the averaging in eqn. (5) is unnecessary since the points overlap-added together are identical. The input can simply be copied into the output stream. In effect, shift prediction behaves like a modify-on-demand system, since splicing and overlap-adding will only be necessary if the predicted shift $t_m$ falls outside the allowable range $[0, K_{max}]$. For mild compression or expansion, with $S_s \simeq S_a$, most of the shifts will be predictable and only occasional splicing will be necessary to modify the time-scale.

Figure 8:
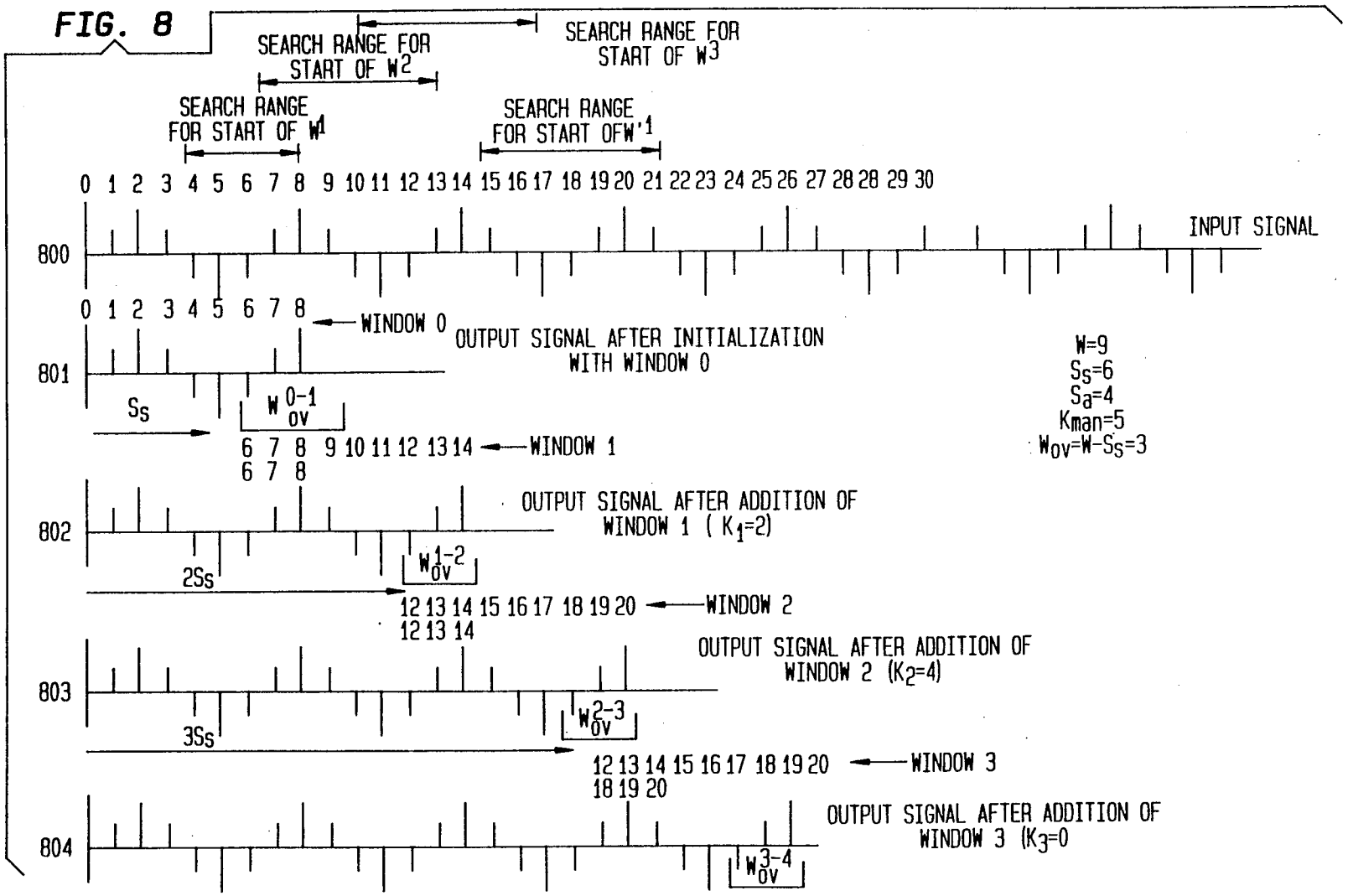
FIG. 8 shows, in pictorial form, the manner in which an embodiment of the present invention operates to provide time-scale modification utilizing "prediction."

FIG. 8 shows, in pictorial form, the operation of an embodiment of the inventive SOLAFS method for a case of moderate time-scale expansion, i.e., $W=9$, $S_s=6$, $S_a=4$, $K_{max}=5$, where "prediction" may be used. As shown in FIG. 8, line 800 displays signal representations for a periodic input signal. Line 801 displays an output signal after the initialization step of the SOLAFS method As shown in line 801, the last $W_{OV}$ signal representations of the output signal—labelled as points 6, 7, and 8—are used to obtain a similarity measure for determining the starting position of the first window. Note that the axes for lines 800–804 have been aligned in FIG. 8 in order to better illustrate the relationships among key regions of the input and output signals during processing. Line 800 also displays the region of possible starting locations for the start of each window to be added to the output signal.

As is evident from lines 800 and 801 in FIG. 8, the search interval for the start of window 1 on line 800 contains the same signal representations that are used in the output signal to evaluate the similarity measure, i.e., signal representations in $W^{0\text{-}1}{}_{OV}$ of line 801. As a result, a shift which aligns such signal representations in the overlap region of window 1 with the end of the output signal of line 801 will be selected as the shift which maximizes the similarity measure from the range of possible starting positions. The shift which accomplishes this result can be calculated using eqn. (13). In this case, $t1=k_0+(S_s-S_a)=0+2=2$, and $k_1=2$. Such a shift can be determined without evaluating the similarity measure as long as the starting point of $W_{OV}$ from the output signal is present in the range of possible starting positions for the next window.

Line 802 in FIG. 8 shows the output signal after the addition of window 1 from the input signal From the numbers shown above the signal representations in FIG. 8 one can see that no arithmetical merging was required in the overlap region since the points were identical and subsequent data points were merely appended to the output signal. Similarly, in line 803, the start of window 2 is selected so as to align regions of overlap and the shift which accomplishes this result can be calculated using eqn. (13): $t_2=k_1+(S_s-S_a)=2+2=4$, and $k_2=4$.

For window 3, however, the region of output used in the similarity evaluation, $W^{2\text{-}3}{}_{OV}$ on line 803, is not present in the search range of possible starting positions. In this case, the shift to align the regions using eqn. (13)—$t_3=k_2+(S_s-S_a)=4+2=6$—is greater than $K_{max}$ and is not possible. Thus, the similarity measure for all possible shifts must be evaluated to determine the best possible shift.

On line 804, a shift of 0 is selected as the best shift and the signal representations from window 3 in the region of overlap, $W^{2\text{-}3}{}_{OV}$ from line 803, are no longer identical to the last $W_{OV}$ signal representations from the output signal, line 803, and must be arithmetically merged to extend the output signal as shown on line 804. At this point, predicting the best shift becomes possible since the points in $W^{3\text{-}4}{}_{OV}$ in line 804 appear in the search range for the start of window 4 in line 800.

The bulk of the computation in the inventive SOLAFS method revolves around computing the normalized cross-correlation $R^m{}_{xy}[k]$ and choosing the maximum This can be simplified in several ways. For example, one can avoid the square root in choosing $k_m$ using the following:

$$k_m \leftarrow \max_{0 \leqq k \leqq K_{max}} r^m_{xy}[k] \, | r^m_{xy}[k] | / \{ r^m_{xx}[k] * r^m_{yy} \} \tag{14}$$

or even more simply:

$$k_m \leftarrow \max_{0 \leqq k \leqq K_{max}} r^m_{xy}[k] \, | r^m_{xy}[k] | / r^m_{xx}[k] \tag{15}$$

Since the value of $r^m{}_{yy}$ is constant over all values of k in the comparisons.

Further simplifications result by computing $r^m{}_{xx}[k]$ recursively:

$$r^m{}_{xx}[k+1]=r^m{}_{xx}[k]+x^2[mS_a+k+W]-x^2[mS_a+k] \tag{16}$$

Both eqns. (14) and (15) give precisely the same answer as eqn. (6), however, eqn. (15) requires the least amount of computation since the constant $r^m{}_{yy}$ is not used and, thus, is not computed.

On the other hand, eqn. (14) is always scaled so that its magnitudes are less than or equal to 1. This may be convenient in a fixed-point implementation. Care must be used with fixed-point arithmetic for all three approaches to avoid overflow when computing cross-correlations $r_{xy}$, $r_{xx}$, and $r_{yy}$.

The inventive SOLAFS method requires a $W_{OV}$ length output buffer to hold the last samples of the output, i.e., $y[mS_s], \ldots, y[mS_a+W_{OV}-1]$, and a $W+K_{max}$ length input buffer to hold the input samples that might be used in the next analysis window, $x[mS_a], \ldots, x[mS_a+W+K_{max}-1]$. One must take note of the fact that in a real-time application, time-scale compression will require reading in input data at a much faster rate than usual. This may cause difficulties if the data is stored in compressed form and must be decoded, or if the storage unit is slow.

Figure 5:
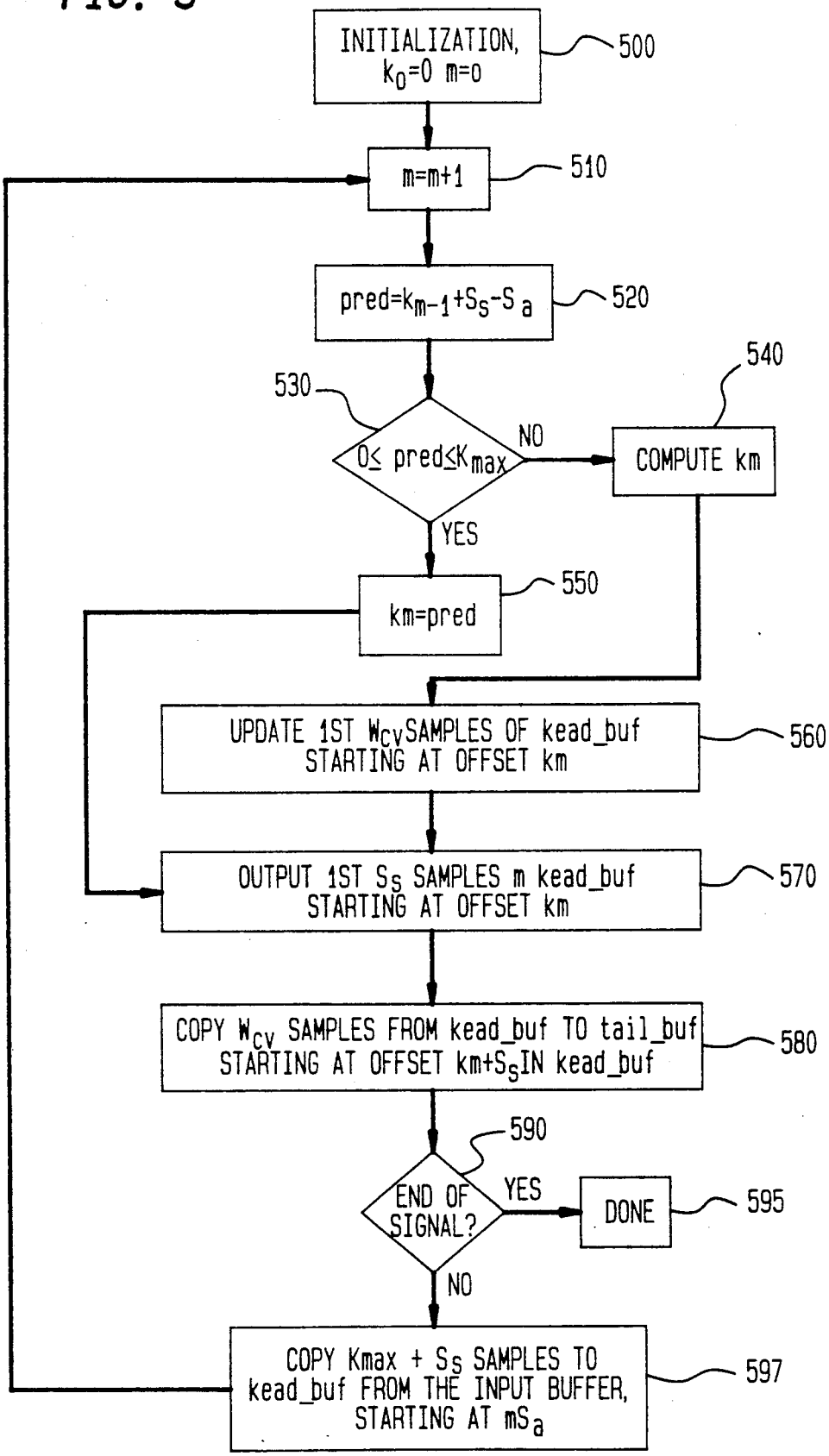
FIGS. 5–7 show a flowchart of the inventive SOLAFS method.
Figure 6:
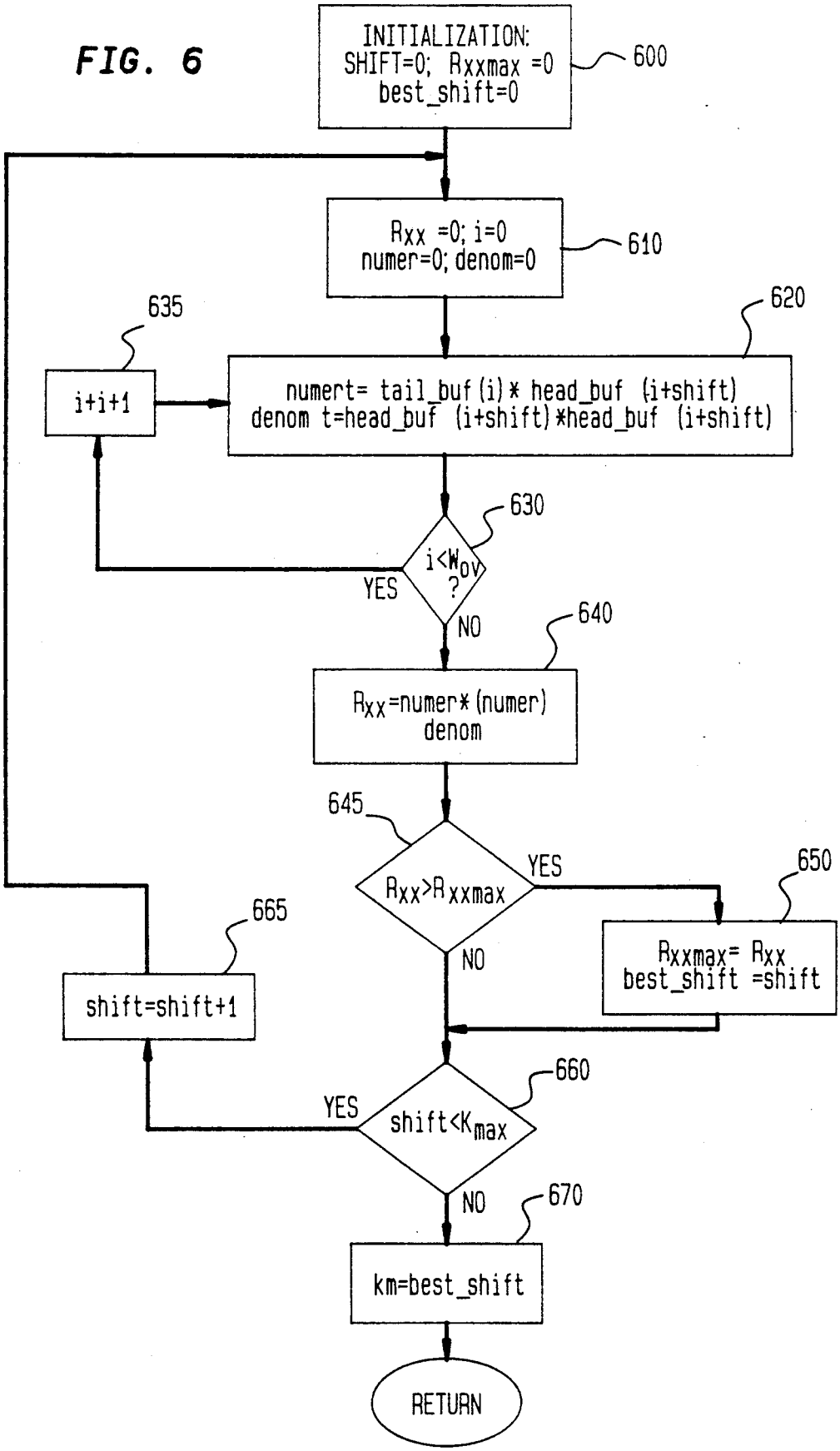
Figure 7:
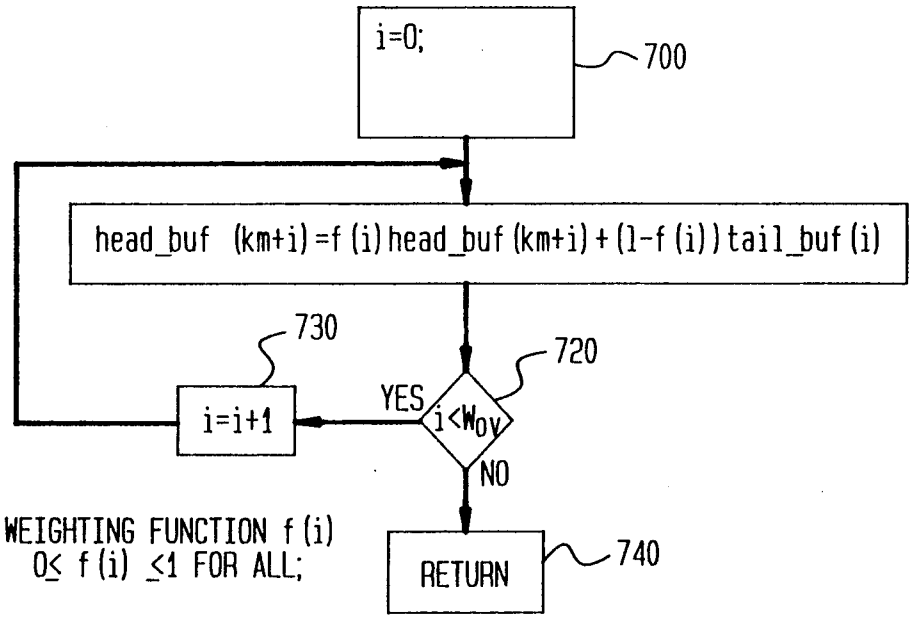

FIGS. 5–7 show a flowchart of one embodiment of the inventive SOLAFS method. The following is nomenclature which is used in the following flowchart: (a) W is the window length and represents the smallest block or unit of a signal that is manipulated by the inventive method; (b) $S_a$ is the analysis shift and represents the interframe interval between successive search intervals along the input signal; (c) $S_s$ is the synthesis shift and represents the interframe interval between successive windows in the output signal; (d) $k_m$ is the window shift and represents the number of data samples the $m^{th}$ analysis window is shifted from its target position, $mS_a$, to provide alignment with previous windows; (e) $K_{max}$ is the maximum window shift, i.e., $0 \leqq k_m \leqq K_{max}$ for all m; (f) $W_{OV}=W-S_s$ is the fixed number of overlapping points between windows; (g) head_buf is a storage buffer for samples from an input signal buffer, head_buf has a length of $K_{max}+W$; and (h) tail_buf is a storage buffer of length $W_{OV}$.

As shown at box 500 of FIG. 5, the program performs an initialization step and sets $k_0=0$ and $m=0$. Then, control is shifted to box 510. In the initialization step, the program processes the first W samples in the input signal by copying $S_s$ samples, i.e., samples 0 to $S_s-1$, from the input signal buffer to an output signal buffer and by copying $W_{OV}$ samples, i.e., samples $S_s$ to $W-1$ from the input buffer to tail_buf.

At box 510 of FIG. 5, the program increments m by 1. Then, control is transferred to box 520.

At box 520 of FIG. 5, the program sets the variable pred equal to $k_{m-1}+S_s-S_a$. Then, control is transferred to decision box 530.

At decision box 530 of FIG. 5, the program determines whether $0 \leqq \mathbf{pred} \leqq K_{max}$. If so, control is transferred to box 550, otherwise, control is transferred to box 540.

At box 540 of FIG. 5, the program computes $k_m$ in accordance with a flowchart which is shown in FIG. 6 and which is described in detail below. Then, control is transferred to box 560.

At box 550 of FIG. 5, the programs sets $k_m$=pred. Then, control is transferred to box 570.

At box 560 of FIG. 5, the program updates the first $W_{OV}$ samples of head_buf starting at offset $k_m$ by performing an overlap add using a weighting function in accordance with the flowchart show in FIG. 7. Then, control is transferred to box 570.

At box 570 of FIG. 5, the program copies $S_s$ samples, starting at offset $k_m$, from head_buf to the output buffer. Then, control is transferred to box 580.

At box 580 of FIG. 5, the program copies $W_{OV}$ samples from head_buf to tail_buf, starting at offset $k_m+S_s$ in head_buf. Then, control is transferred to decision box 590.

At decision box 590 of FIG. 5, the program determines whether the end of the signal has been reached. If so, control is transferred to box 595 to output the signal by converting it into an analog form or for further processing, otherwise, control is transferred to box 597.

At box 597 of FIG. 5, the program copies $K_{max}+W$ samples from the input buffer, starting at sample $m*S_a$, to head_buf. Then, control is transferred to box 510.

FIG. 6 shows a flowchart of a procedure for computing $k_m$. At box 600 of FIG. 6, the program initializes variables by setting shift=0; $R_{xxmax}=0$; and best_shift=0. Then, control is transferred to box 610.

At box 610 of FIG. 6, the program initializes loop variables $R_{xx}$, i, numer, and denom by setting $R_{xx}=0$, i=0, numer=0, and denom=0. Then, control is transferred to box 620.

At box 620 of FIG. 6, the program adds the following amount to numer: tail_buf[i]*head_buf[i] and adds the following amount to denom: head_buf[i+shift]*head_buf[i+shift]. Then, control is transferred to decision box 630.

At decision box 630 of FIG. 6, the program determines whether $i<W_{OV}$. If so, control is transferred to box 635, otherwise, control is transferred to box 640.

At box 635 of FIG. 6, the program increments i by 1. Then, control is transferred to box 620.

At box 640, the program sets $R_{xx}$=numer*|numer|/denom. Then, control is transferred to decision box 645.

At decision box 645, the program determines whether $R_{xx}$ is greater than $R_{xxmax}$. If so, control is transferred to box 650, otherwise, control is transferred to decision box 660.

At box 650 of FIG. 6, the program replaces the old value of $R_{xxmax}$ with the value of $R_{xx}$ and replaces the old value of best_shift with shift. Then, control is transferred to decision box 660.

At decision box 660 of FIG. 6, the program determines whether shift is less than $K_{max}$. If so, control is transferred to box 665, otherwise, control is transferred to box 670.

At box 665 of FIG. 6, the program increments shift by 1. Then, control is transferred to box 610.

At box 670 of FIG. 6, $k_m$ is set equal to best_shift. Then, control is transferred to box 680 to return.

FIG. 7 shows a flowchart of a procedure for updating the first $W_{OV}$ points of head_buf using a weighting function to perform overlap adding. At box 700 of FIG. 7, the program initializes loop variable i by setting i=0. Then, control is transferred to box 710.

At box 710 of FIG. 7, the program performs an overlap-add by computing head_buf[$k_m$+i]=f(i) head_buf[$k_m$+i]+(1−f(i))tail_buf[i]; where f(i) is a weighting function and $0 \leqq f(i) \leqq 1$ for all i. Then, control is transferred to decision box 720.

At decision box 720 of FIG. 7, the program determines whether i is less than $W_{OV}$. If so, control is transferred to box 730, otherwise, control is transferred to box 740 to return.

At box 730 of FIG. 7, the program increments i by 1. Then, control is transferred to box 710.

Large shifts $S_s$, $S_a$, and windows W cause problems in time-scale modification because the signal data may change character radically between windows. Note that $|(S_s-S_a)|$ determines the minimum number of samples inserted or deleted when the shift predicted lies outside the range [0, $K_{max}$]. This is why small analysis shifts are beneficial in SOLAFS. In SOLAFS, although the number of windows increases with decreasing analysis shift, $S_a$, the number of predictable shifts increases since the quantity $(S_s-S_a)$ in eqn. (13) decreases. Thus, the benefits of using small analysis shifts can be obtained without large increases in computation.

The window size, synthesis shift, and length of the overlap region are all interrelated. The amount of computation required to determine unpredictable shift values is on the order of $|K_{max}W^2_{OV}|$ multiply/adds, and thus efficient parameter combinations will use as small a value of $W_{OV}$ as possible. The number of overlap points $W_{OV}$ must not be too small, however, or else the variance of the similarity computation will be too large and transitions between segments will be audible. For voicemail applications with 8 kHz sampling, $W_{OV}=30$ samples appears to be sufficient and results in smooth transitions.

To determine an appropriate window size, note that $W=S_s+W_{OV}$. If one wishes to have at most two windows overlap at any point in the output, one requires that $S_s \geqq W_{OV}$. In this case, the smallest useful synthesis shift is $S_s=W_{OV}$, and the smallest useful window length is $W=2W_{OV}$. It is also possible to choose the synthesis shift to be less than the overlap region, $S_s<W_{OV}$, in which case more than two windows will overlap in certain regions. This allows a somewhat smoother transition between windows, but it increases the computation and the shifts predicted by eqn. (13) are no longer guaranteed to maximize the similarity in the overlap region. With $S_s$ fixed, the analysis shift, $S_a$, is chosen to achieve the desired compression or expansion rate. Note that non-integer values of $S_a$ are acceptable, since $S_a$ is only used to compute the range of starting positions of the windows at each iteration.

The maximum shift $K_{max}$ is an important parameter. This must be chosen to be larger than the largest expected pitch period in the input signal to avoid pitch fracturing. In a voicemail application with male speakers and 8 kHz sampling, a preferred choice is $K_{max}=100$ samples. This choice allows synchronization of periods down to 80 Hz when time-scale modifying music as well.

It is not necessary to choose $S_a$ to be larger than $K_{max}$. However, if $S_a < K_{max}$, some care should be used to ensure that during analysis each window starts at a time no earlier than the previous window, $k_m + S_a \geqq k_{m-1}$. Thus, best results occur if eqn. (13) is modified so that the maximum over $R^m_{xy}[k]$ is computed only over the range $\max(0, k_{m-1} - S_a) \leqq k \leqq K_{max}$.

Evaluations of SOLAFS were performed using speech from male and female speakers which was bandlimited to 3.8 kHz and which was sampled at 8 kHz using 16-bit linear quantization. High-quality output was obtained over a wide range of window lengths, analysis shifts, and synthesis shifts. In all cases, choosing $K_{max}$ to be less than the duration of the largest pitch period in the signal drastically degrades output signal quality. Very slight fluttering was detectable in voiced segments of compressed-by-2 speech with $W_{OV}=20$ samples. This artifact diminished rapidly with increasing $W_{OV}$ and was undetectable at $W_{OV}=40$ samples.

The following parameter choices provided high-quality output for time-scale expansion by 2 ($a=0.5$): $W=120$, $S_a=40$, $S_a=80$, and $K_{max}=100$ where these parameter values are set forth in number of 8 kHz samples. High-quality time-scale compressed by 2 speech ($a=2$) was obtained with: $W=120$, $S_a=160$, $S_a=80$, $K_{max}=100$ for a sampling rate of 8 kHz. Slight improvements in quality may be gained by decreasing $S_a$ and W, though such improvements are barely audible.

The amount of time-scale modification performed, quality, or computational efficiency of the method can be altered during processing of a particular signal by changing the parameter values W, $S_s$, or $S_a$. Recall that $a=S_s/S_a$, so that a decrease or increase in $S_a$ will cause an increase or decrease in a, respectively. It may also be desirable to change W or $S_s$, in which case, the quantity $W_{OV}=W-S_s$ may change, but operation of the method will otherwise remain the same.

Those of ordinary skill in the art will readily appreciate that numerous different types of similarity measures may be used to determine shift values in carrying out the inventive method. Further, those of ordinary skill in the art will readily appreciate that the number of computations required to provide a similarity measure would be reduced if the similarity measure did not comprise a denominator normalizing factor. Such a similarity measure may be developed when one considers that alignment affects the quality most during periodic portions of the speech signal. These portions of the speech signal represent voiced segments which have periods between 3.75 msec and 12.5 msec (30 and 100 samples at a 8 kHz sampling rate). If one assumes that the pitch period is the highest amplitude frequency in these portions, it is valid to assume that the shift which results in the highest number of agreeing signs will also align these periods. This gives the following similarity measure:

$$R^m_{xy}(k) = \operatorname*{Sum}_{j=0}^{L_m-1} \{\mathrm{sign}[y(mS_s - k(m) + j)]\mathrm{sign}[x(mS_a + j)]\} \tag{17}$$

This similarity measure weighs all samples equally and it eliminates the need for normalizing the similarity measure by signal power. Further, this similarity measure makes full use of the periodic structure of those portions of the input speech signal which are most sensitive to alignment. In essence, this converts a complicated input speech signal into a square wave of unity amplitude whose zero crossings match those of the speech signal and, as a result, the number of agreeing signs is identical to a cross-correlation on this unity amplitude square wave. The resulting similarity measure is, therefore, a good approximation to the more complex cross-correlation and, yet, requires no multiplications. Thus, in determining this similarity measure, a key operation performed on the data is an exclusive or (XOR) on the sign bits of the data. Since only the sign bits are used, an efficient embodiment involves stripping sign bits from the data and loading them into a buffer of bit length equal to $(W+K_{max})$. A similar buffer holds the sign bits of the last $W_{OV}$ points in the output buffer. The desired shift then corresponds to the bit offset between buffers providing the largest number of 0's, i.e., a false for XOR, in the XOR result in the $W_{OV}$ points from the output and input (head_buf) buffers. Digital signal processors are commercially available for performing this type of population count of bits on numbers in a single instruction. Note that such an embodiment advantageously permits operation on blocks of the input data rather than on single samples. For example, 8 samples for byte operation, 16 samples for word operations, and so forth. Alternatively, the input signal can be pre-processed to +1 or −1 for all samples. A single bit multiply-accumulate would correspond to the number of agreeing signs; and assuming less than 256 overlapping points, only 8 bits plus a sign bit would be required for the accumulation sum.

We have determined that alignment is most critical during voiced portions of speech signals. The nature of the signal in these portions, i.e., large amplitude fundamental periods, make it possible to reduce computations by evaluating the similarity measure for shifts using decimated data and by evaluating the similarity measure for shifts using reduced shift resolution such as, for example, by evaluating the similarity measure for every other shift. It is also possible to overlap-add/linearly fade over more data points than are used in the similarity measure calculation. This allows smoother transitions without an increase in computation, but restricts the similarity measure determination to a fraction of the total segments to be overlap-added.

The ability to perform high quality compression and expansion provides means for a time-based voice compression system. When time-scale compression is followed by expansion, without error, combining the two techniques reduces the data required for coding and storing speech signals. This method of compression may be combined with other compression techniques to further reduce the bit rate. Time-scale compressed speech may also be encoded using alternative techniques which are well known to those of ordinary skill in the art such as, for example, vector quantization, quadrature mirror filtering, and pulse code modulation. After decoding, the time-scale compressed signal is expanded by an appropriate factor to obtain speech with the original time-scale.

Although the inventive SOLAFS method has been described with reference to the application thereof to samples of a signal for ease of understanding, it should be noted that the inventive method is not limited to operating on samples of the signal. In particular, the method operates by searching for similar regions in an input and an output and then overlapping the regions to produce a time-scale modified output. The method can also be applied to numerous signal representations other than samples. For example, it is possible to use the inventive method by searching for similar regions in signal representations of an input and an output stream of signal representations using an appropriate similarity measure and then overlapping the regions by combining the signal representations to produce a time-scale modified output stream of signal representations. As one particular example, for use in sub-band coding, the data necessary to represent a portion of a signal is reduced by encoding information about the energy in specific frequency bands. In using the inventive SOLAFS method on the sub-band coded representation of the signal, similar sub-band characteristics would be merged to form an output stream of signal representations of the time-scale modified signal. Employing the method reduces the overhead associated with converting the input stream of encoded signal representations to an input stream of samples before processing.

What is claimed is:

1. A method for time-scale modification of a signal comprised of an input stream of signal representations to form an output stream of signal representations, the method comprising the steps of:

determining an input block of W signal representations from the input stream for use in overlapping signal representations from the input block with signal representations in the output stream; and overlapping $W_{OV}$ signal representations from the beginning of the input block with $W_{OV}$ signal representations from the end of the output stream, where $W_{OV}$ is determined by W and the time-scale modification.

2. The method of claim 1 wherein the step of overlapping comprises the step of:

applying a weighting function to $W_{OV}$ signal representations from the beginning of the input block and to $W_{OV}$ signal representations from the end of the output stream to determine values of $W_{OV}$ signal representations to be substituted for the $W_{OV}$ signal representations at the end of the output stream; and wherein the step of overlapping further comprises the step of:

placing $W-W_{OV}=S_s$ signal representations from the input stream at the end of the output stream, the $S_s$ signal representations being subsequent to the $W_{OV}$ signal representations from the beginning of the input block.

3. The method of claim 2 wherein:

the step of determining an input block comprises the steps of:

determining an initial input block of $W+K_{max}$ signal representations from the input stream, where $K_{max}$ is a predetermined amount;

determining a maximum of a similarity measure between $W_{OV}$ signal representations from the initial input block and $W_{OV}$ signal representations from the end of the output stream over a fixed search range of $K_{max}$ signal representations, the search starting at the beginning of the initial input block; and determining the input block to comprise W signal representations which begin at the sample in the initial input block whose $W_{OV}$ signal representations provided a maximum of the similarity measure.

4. The method of claim 3 wherein the step of determining an initial input block comprises the step of:

determining the first signal representation of the $m^{th}$ initial input block as being the signal representation which occurs $mS_a$ signal representations after the first sample in the input stream, where $S_a$ is a predetermined amount;

and wherein the step of determining a maximum of the similarity measure comprises the steps of:

determining a similarity measure for the $W_{OV}$ signal representations starting at the beginning of the initial input block and the $W_{OV}$ signal representations at the end of the output stream;

shifting the beginning of the initial input block and repeating the previous step over the fixed search range; and determining the maximum similarity measure.

5. The method of claim 4 wherein the similarity measure is a cross-correlation.

6. The method of claim 5 wherein the weighting function is a average.

7. The method of claim 3 wherein the step of determining a maximum of a similarity measure comprises the steps of:

determining a single-bit, square-wave, correlation function.

8. The method of claim 7 wherein the step of determining a single-bit, square-wave, correlation function comprises the step of determining a logical exclusive OR of sign-bits of the signal signal representations.

9. The method of claim 5 wherein the weighting function provides a linear fade.

10. A method for time-scale modification of a signal comprised of an input stream of signal representations to form an output stream of signal representations, the method comprising the steps of:

determining a number of signal representations for use in overlapping signal representations from the input stream to the output stream, $W_{OV}$;

determining an input block of W signal representations from the input stream for use in overlapping signal representations from the input block with signal representations in the output stream; and overlapping $W_{OV}$ signal representations from the beginning of the input block with $W_{OV}$ signal representations from the end of the output stream.

11. The method of claim 10 wherein the step of overlapping comprises the step of:

applying a weighting function to $W_{OV}$ signal representations from the beginning of the input block and to $W_{OV}$ signal representations from the end of the output stream to determine values of $W_{OV}$ signal representations to be substituted for the $W_{OV}$ signal representations at the end of the output stream; and wherein the step of overlapping further comprises the step of:

placing $W-W_{OV}=S_s$ signal representations from the input stream at the end of the output stream, the $S_s$ signal representations being subsequent to the $W_{OV}$ signal representations from the beginning of the input block.

12. The method of claim 11 wherein:

the step of determining an input block comprises the steps of:

determining an initial input block of $W+K_{max}$ signal representations from the input stream, where $K_{max}$ is a predetermined amount;

determining a maximum of a similarity measure between $W_{OV}$ signal representations from the initial input block and $W_{OV}$ signal representations from the end of the output stream over a fixed search range of $K_{max}$ signal representations, the search starting at the beginning of the initial input block; and determining the input block to comprise W signal representations which begin at the sample in the initial input block whose $W_{OV}$ signal representations provided a maximum of the similarity measure.

13. The method of claim 12 wherein the step of determining an initial input block comprises the step of:

determining the first sample of the $m^{th}$ initial input block as being the sample which occurs $mS_a$ signal representations after the first sample in the input stream, where $S_a$ is a predetermined amount;

and wherein the step of determining a maximum of the similarity measure comprises the steps of:

determining a similarity measure for the $W_{OV}$ signal representations starting at the beginning of the initial input block and the $W_{OV}$ signal representations at the end of the output stream;

shifting the beginning of the initial input block and repeating the previous step over the fixed search range; and determining the maximum similarity measure.

14. The method of claim 13 wherein the similarity measure is a cross-correlation.

15. The method of claim 14 wherein the weighting function is a average.

16. The method of claim 12 wherein the step of determining a maximum of a similarity measure comprises the steps of:

determining a single-bit, square-wave, correlation function.

17. The method of claim 16 wherein the step of determining a single-bit, square-wave, correlation function comprises the step of determining a logical exclusive OR of sign-bits of the signal type representations.

18. The method of claim 14 wherein the weighting function provides a linear fade.

19. A method which comprises the steps of:

time-scale modifying a signal comprised of an input stream of signal representations to form an output stream of signal representations wherein at least one of the steps of time-scale modifying comprises:

determining an input block of signal representations from the input stream for use in appending signal representations from the input block to signal representations in the output stream, where the number appended is determined by the time-scale modification; and appending the signal representations to the end of the output stream.

20. The method of claim 1 wherein the method comprises the further step of overlapping signal representations which are more than $W_{OV}$ signal representations from the beginning of the input block.

* * * * *